US010066281B2

(12) United States Patent
Higashida et al.

(10) Patent No.: US 10,066,281 B2
(45) Date of Patent: Sep. 4, 2018

(54) AGE-HARDENABLE STEEL

(71) Applicants: NIPPON STEEL & SUMITOMO METAL CORPORATION, Tokyo (JP); DENSO CORPORATION, Aichi (JP)

(72) Inventors: Masashi Higashida, Tokyo (JP); Masato Yuya, Tokyo (JP); Hitoshi Matsumoto, Tokyo (JP); Tatsuya Hasegawa, Tokyo (JP); Yutaka Neishi, Tokyo (JP); Taizo Makino, Tokyo (JP); Kouji Morita, Aichi (JP); Yoshihiro Tanimura, Aichi (JP); Toshimasa Ito, Aichi (JP); Tomomitsu Fukuoka, Aichi (JP); Tadashi Nishiwaki, Aichi (JP)

(73) Assignees: NIPPON STEEL & SUMITOMO METAL CORPORATION, Tokyo (JP); DENSO CORPORATION, Aichi (JP)

( * ) Notice: Subject to any disclaimer, the term of this patent is extended or adjusted under 35 U.S.C. 154(b) by 0 days.

(21) Appl. No.: 14/763,976

(22) PCT Filed: Oct. 1, 2014

(86) PCT No.: PCT/JP2014/076261
§ 371 (c)(1),
(2) Date: Jul. 28, 2015

(87) PCT Pub. No.: WO2015/050152
PCT Pub. Date: Apr. 9, 2015

(65) Prior Publication Data

US 2016/0265092 A1 Sep. 15, 2016

(30) Foreign Application Priority Data

Oct. 2, 2013 (JP) ..... 2013-207202

(51) Int. Cl.

| | |
|---|---|
| ***C22C 38/58*** | (2006.01) |
| ***C22C 38/00*** | (2006.01) |
| ***C22C 38/02*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/28*** | (2006.01) |
| ***C22C 38/38*** | (2006.01) |
| ***C22C 38/42*** | (2006.01) |
| ***C22C 38/44*** | (2006.01) |
| ***C22C 38/46*** | (2006.01) |
| ***C22C 38/50*** | (2006.01) |
| ***C22C 38/60*** | (2006.01) |
| *C21D 8/00* | (2006.01) |

(52) U.S. Cl.

CPC ..... *C22C 38/58* (2013.01); *C22C 38/00* (2013.01); *C22C 38/001* (2013.01); *C22C 38/002* (2013.01); *C22C 38/02* (2013.01); *C22C 38/06* (2013.01); *C22C 38/20* (2013.01); *C22C 38/22* (2013.01); *C22C 38/24* (2013.01); *C22C 38/28* (2013.01); *C22C 38/38* (2013.01); *C22C 38/42* (2013.01); *C22C 38/44* (2013.01); *C22C 38/46* (2013.01); *C22C 38/50* (2013.01); *C22C 38/60* (2013.01); *C21D 8/005* (2013.01); *C21D 2211/002* (2013.01)

(58) Field of Classification Search

CPC ..... C22C 38/58; C22C 38/50; C22C 38/46; C22C 38/44; C22C 38/42; C22C 38/38; C22C 38/28; C22C 38/00; C22C 38/001; C22C 38/002; C22C 38/02; C22C 38/06; C22C 38/20; C22C 38/22; C22C 38/24; C22C 38/60; C21D 8/005; C21D 2211/002

USPC ..... 420/91

See application file for complete search history.

(56) References Cited

U.S. PATENT DOCUMENTS

| | | | | |
|---|---|---|---|---|
| 5,567,250 | A * | 10/1996 | Akamatsu | B22D 11/124 148/320 |
| 2004/0149359 | A1* | 8/2004 | Michaud et al. | 148/546 |
| 2010/0003535 | A1* | 1/2010 | Hara et al. | 428/586 |

FOREIGN PATENT DOCUMENTS

| | | |
|---|---|---|
| CN | 103003459 | 3/2013 |
| EP | 2 578 717 | 4/2013 |
| JP | 04-154936 | 5/1992 |
| JP | 2000-017374 | 1/2000 |
| JP | 2004-169055 | 6/2004 |
| JP | 2006-037177 | 2/2006 |
| JP | 4415219 | 2/2010 |
| JP | 2011-236452 | 11/2011 |
| JP | 2012-177167 | 9/2012 |
| JP | 2012-193416 | 10/2012 |
| JP | 2013-253265 | 12/2013 |
| WO | 2010/090238 | 8/2010 |
| WO | 2011/145612 | 11/2011 |
| WO | 2012/067181 | 5/2012 |
| WO | 2012/161321 | 11/2012 |
| WO | 2012/161323 | 11/2012 |

* cited by examiner

*Primary Examiner* — Helene Klemanski
(74) *Attorney, Agent, or Firm* — Clark & Brody

(57) ABSTRACT

An age-hardenable steel having a composition consisting of: C: 0.05 to 0.20%, Si: 0.01 to 0.50%, Mn: 1.5 to 2.5%, S: 0.005 to 0.08%, Cr: more than 0.50% and not more than 1.6%, Al: 0.005 to 0.05%, V: 0.25 to 0.50%, Mo: 0 to 1.0%, Cu: 0 to 0.3%, Ni: 0 to 0.3%, Ca: 0 to 0.005%, and Bi: 0 to 0.4%, the balance being Fe and impurities. Within the impurities, P≤0.03%, Ti<0.005%, and N<0.0080%, and [C+0.3Mn+0.25Cr+0.6Mo≥0.68], [C+0.1Si+0.2Mn+0.15Cr+0.35V+0.2Mo≤1.05], and [−4.5C+Mn+Cr−3.5V−0.8Mo≥0.12]. The steel has hardness before aging of not more than 310 HV. After aging, the fatigue strength is not less than 480 MPa and absorbed energy at 20° C. is not less than 12 J.

8 Claims, No Drawings

AGE-HARDENABLE STEEL

TECHNICAL FIELD

The present invention relates to an age-hardenable steel. More specifically, the present invention relates to a steel which is processed into a desired shape by hot forging and cutting process, and is thereafter subjected to age-hardening treatment (hereafter, simply referred to as "aging treatment") to ensure desired strength and toughness by the aging treatment, and which is quite suitably used as a starting material for producing mechanical parts such as for automobiles, industrial machinery, construction machinery, and the like.

BACKGROUND ART

From the viewpoint of weight reduction for the purpose of increasing output power of engines and fuel economy, high fatigue strength is required for mechanical parts such as for automobiles, industrial machinery, construction machinery, and so on. Simply imparting high fatigue strength to steel can be easily achieved by increasing the hardness of steel by utilizing alloying elements and/or heat treatment. However, in general, the above described mechanical parts are formed by hot forging and thereafter finished into a predetermined product shape by cutting process. For this reason, the steel to be used as the starting material for the above described mechanical parts must have high fatigue strength and satisfactory machinability at the same time. In general, as the hardness of the starting material increases, the fatigue strength increases. On the other hand, regarding machinability, as the hardness of the starting material increases, cutting resistance and tool life tend to deteriorate.

Accordingly, to achieve fatigue strength and machinability at the same time, various techniques have been disclosed which allow the hardness to be suppressed to a low level in a forming stage in which high machinability is required and, on the other hand, allow the hardness to be increased by thereafter performing aging treatment in a final product stage in which strength is required.

For example, Patent Document 1 discloses the following age-hardening steel.

That is, there is disclosed an "age-hardening steel" containing: by mass %, C: 0.11 to 0.60%, Si: 0.03 to 3.0%, Mn: 0.01 to 2.5%, Mo: 0.3 to 4.0%, V: 0.05 to 0.5%, and Cr: 0.1 to 3.0%, and further containing, as needed, one or more kinds of Al: 0.001 to 0.3%, N: 0.005 to 0.025%, Nb: 0.5% or less, Ti: 0.5% or less, Zr: 0.5% or less, Cu: 1.0% or less, Ni: 1.0% or less, S: 0.01 to 0.20%, Ca: 0.003 to 0.010%, Pb: 0.3% or less and Bi: 0.3% or less, with the balance being Fe and inevitable impurities, wherein the following relationships are established among each component:

$$4C+Mn+0.7Cr+0.6Mo-0.2V \geq 2.5,$$

$$C \geq Mo/16+V/5.7,$$

$$V+0.15Mo \geq 0.4$$

and wherein after rolling, forging, or solution treatment, the steel is cooled at an average cooling velocity of 0.05 to 10° C./sec in a temperature range of 800° C. to 300° C. so that before the aging treatment, an area fraction of bainite structure is not less than 50%, hardness thereof is not more than 40 HRC, and the hardness becomes 7 HRC or more higher than that before the aging treatment, due to the aging treatment.

Patent Document 2 discloses the following bainite steel.

That is, there is disclosed a "bainite steel", containing: by mass %, C: 0.14 to 0.35%, Si: 0.05 to 0.70%, Mn: 1.10 to 2.30%, S: 0.003 to 0.120%, Cu: 0.01 to 0.40%, Ni: 0.01 to 0.40%, Cr: 0.01 to 0.50%, Mo: 0.01 to 0.30%, and V: 0.05 to 0.45% and further containing, as needed, one or more kinds selected from Ti: 0.001 to 0.100%, and Ca: 0.0003 to 0.0100%, with the balance being Fe and inevitable impurities, wherein the following relationships are satisfied:

$$13[C]+8[Si]+10[Mn]+3[Cu]+3[Ni]+22[Mo]+11[V] \leq 30,$$

$$5[C]+[Si]+2[Mn]+3[Cr]+2[Mo]+4[V] \leq 7.3,$$

$$2.4 \leq 0.3[C]+1.1[Mn]+0.2[Cu]+0.2[Ni]+1.2[Cr]+1.1[Mo]+0.2[V] \leq 3.1,$$

$$2.5 \leq [C]+[Si]+4[Mo]+9[V], \text{ and}$$

$$[C] \geq [Mo]/16+[V]/3.$$

Patent Document 3 discloses the following age-hardening type high-strength bainite steel.

That is, there is proposed an age-hardening type high-strength bainite steel having a chemical composition containing: by mass %, C: 0.06 to 0.20%, Si: 0.03 to 1.00%, Mn: 1.50 to 3.00%, Cr: 0.50 to 2.00%, Mo: 0.05 to 1.00%, Al: 0.002 to 0.100%, V: 0.51 to 1.00%, N: 0.0080 to 0.0200%, and further containing, as needed, one or more kinds selected from Ti: 0.01 to 0.10%, Nb: 0.01 to 0.10%, S: 0.04 to 0.12%, Pb: 0.01 to 0.30%, Ca: 0.0005 to 0.01%, and REM: 0.001 to 0.10%, with the balance being Fe and inevitable impurities, wherein the steel is hot rolled or hot forged at a heating temperature of 1150 to 1300° C., and thereafter is cooled to a temperature not more than 200° C. with an average cooling velocity CV (° C./min) in a temperature range of 800 to 500° C. being kept as $40/(Mn\ \%+0.8Cr\ \%+1.2Mo\ \%) \leq CV \leq 500/(Mn\ \%+0.8\%\ Cr+1.2Mo\ \%)$ such that hardness is not more than 400 HV, and micro-structure has a bainite ratio of not less than 70% and a crystal grain diameter of prior austenite of not more than 80 μm, and wherein thereafter the steel is, as needed, subjected to cutting process or plastic working, and is farther subjected to aging treatment at a temperature of 550 to 700° C. such that a yield point or 0.2% yield stress is not less than 900 MPa.

Further, Patent Documents 4 and 5 disclose age-hardenable steels having a predetermined chemical composition or micro structure, and Patent Documents 6 and 7 disclose, as a method for obtaining steel parts for mechanical structures, a method of performing aging treatment, in which steel material is cooled at a predetermined cooling velocity after hot forging, and thereafter is subjected to aging treatment in a predetermined temperature range.

LIST OF PRIOR ART DOCUMENTS

Patent Document

Patent Document 1: JP2006-37177A
Patent Document 2: JP2011-236452A
Patent Document 3: JP2000-17374A
Patent Document 4: WO2010/090238
Patent Document 5: WO2011/145612
Patent Document 6: WO2012/161321
Patent Document 7: WO2012/161323

DISCLOSURE OF THE INVENTION

Problems to be Solved by the Invention

However, attempting to achieve higher strength by causing a fine secondary phase to precipitate in steel by aging treatment will result in deterioration of toughness of steel.

A steel whose toughness has deteriorated has an increased notch susceptibility. With a higher notch susceptibility, the fatigue strength of steel becomes more likely to be affected by fine surface flaws.

Moreover, once a fatigue crack occurs in steel with low toughness, the propagation of the crack becomes faster, and fracture becomes large scaled.

Further, when an attempt is made in the cold to correct distortion which has occurred during hot forging, the correction may become difficult even in a cold condition when toughness of the steel is excessively reduced.

Since the steel disclosed in Patent Document 1 is permitted to have a hardness before aging treatment of up to 40 HRC and thus a very high hardness, it is difficult to ensure machinability, specifically, cutting resistance is high so that tool life is decreased, thereby increasing cutting cost. While steels disclosed as a specific example include those whose hardness before aging treatment is less than 40 HRC, they contain not less than 1.4% of Mo, and in addition to that, their toughness is not taken into consideration at all.

In the steel disclosed in Patent Document 2, the contents of alloying elements are adjusted so as to satisfy a particular parametric formula so that while the content of Mo is kept to be relatively low, the hardness before aging treatment (after hot forging) is not more than 300 HV, and the hardness after aging treatment is not less than 300 HV. However, sufficient efforts have not been made to increase toughness after aging treatment.

In the case of the steel disclosed in Patent Document 3, although C content is suppressed to be as low as 0.06 to 0.20%, since V content is as very high as 0.51 to 1.00%, the strength of the steel is significantly increased by age hardening, but its toughness is not excellent.

Therefore, it is an object of the present invention to provide an age-hardenable steel which satisfies the following items <1> to <3>.

<1> Hardness after hot forging which relates to cutting resistance and tool life is low. Note that in the following description, the hardness after hot forging is referred to as "hardness before aging treatment".

<2> It is possible to impart desired fatigue strength to a mechanical part through aging treatment.

<3> Toughness after aging treatment is high.

Specifically, it is an object of the present invention to provide an age-hardenable steel in which hardness before aging treatment is not more than 310 HV, fatigue strength after aging treatment to be described below is not less than 480 Mpa, and further, absorbed energy at 20° C. after aging treatment is not less than 12 J when evaluated by a Charpy impact test performed by using a standard specimen with a U-notch having a notch depth of 2 mm and a notch bottom radius of 1 mm according to JIS Z 2242.

Means for Solving the Problems

To solve the above described problems, the present inventors have conducted investigation by using steels whose chemical compositions are varied. As a result of that, the following findings (a) to (c) have been obtained.

(a) V exhibits a precipitation peak of carbide at about 750 to 700° C. when cooled from a high temperature. For example, in a steel containing 0.3 mass % of V and 0.1 mass % of C, since once resolved into the matrix, V will not precipitate until around 850° C., suppressing precipitation during hot forging is relatively easy.

(b) V carbide is likely to precipitate at phase boundaries when austenite transforms into ferrite. Therefore, when a large amount of pro-eutectoid ferrite is generated during cooling after hot forging, since V carbide precipitates at phase boundaries thereby reducing the amount of dissolved V, it becomes not possible to secure an amount of dissolved V necessary for precipitating and hardening during aging treatment.

(c) Therefore, to secure dissolved V in a stage before aging treatment, it is necessary that the micro-structure after hot forging contains bainite as a main phase.

Next, the present inventors have investigated conditions for stably obtaining a high area-fraction of bainite in the micro-structure, by varying the chemical composition of steel for a steel containing not less than 0.25 mass % of V. Further, they also investigated the age hardenability of those steels when they are subjected to aging treatment. As a result of that, the following findings (d) to (f) have been obtained.

(d) The micro-structure after hot forging has close correlation with the contents of C, Mn, Cr and Mo. That is, if the contents of the above described elements are controlled such that the value represented by Formula (1), which is to be described below and shows an index of hardenability, falls within a specific range, precipitation of a large amount of pro-eutectoid ferrite, which is harmful for ensuring dissolved V, is suppressed. For this reason, a micro-structure containing bainite as a main phase, that is, a micro-structure containing not less than 70% in area fraction of bainite is obtained with ease so that it is possible to secure a sufficient amount of dissolved V.

(e) When the contents of C, Mn, Cr and Mo satisfy only the condition that Formula (1) described in the above described (d) falls within a specific range, there may a case in which the cutting resistance during cutting process increases, thereby reducing tool life since the hardness before aging treatment increases due to working of solid solution strengthening.

(f) On the other hand, if the contents of C, Si, Mn, Cr, V and Mo are controlled such that the value represented by Formula (2) to be described below falls within a specific range, it is possible to suppress the hardness before aging treatment from excessively increasing.

Further, the present inventors investigated conditions to obtain absorbed energy of not less than 12 J at 20° C. after aging treatment evaluated by a Charpy impact test performed by using a standard specimen with a U-notch having a notch depth of 2 mm and a notch bottom radius of 1 mm, by preparing steels containing not less than 0.25 mass % of V, in which contents of C, Si, Mn, Cr, Mo, and V satisfy both conditions as described in above (d) and (f), and which is subjected to hot forging and thereafter to aging treatment. As a result of that, the following findings (g) to (i) have been obtained.

(g) Elements that deteriorate toughness after aging treatment are C, V, Mo, and Ti. Among those, Ti combines with N and/or C to form TiN and/or TiC. Precipitation of TiN and/or TiC may increase fatigue strength, but it significantly deteriorates toughness. The intensity of action of Ti to deteriorate toughness is very high compared with V and Mo which are similar precipitation strengthening elements. For that reason, the content of Ti must be restricted as much as possible. C forms cementite in steel, and may act as a starting point of cleavage fracture. Even when a steel which contains excess amounts of V and Mo with respect to C is subjected to aging treatment, some part of cementite remains. V and Mo cause carbide to precipitate in the same crystal plane of matrix as a result of aging treatment, thereby accelerating the progress of cleavage fracture and deteriorating toughness. Therefore, to improve toughness, it is necessary to decrease the contents of C, V, and Mo.

(h) Moreover, to improve toughness, it is necessary to refine bainite structure. Refining of bainite structure can be achieved by decreasing the transformation temperature from austenite to bainite. Decreasing of the transformation temperature of bainite can be achieved by increasing the contents of Mn and Cr which decrease the start temperature of bainite transformation.

(i) From what has been described so far, to impart sufficient toughness to an age-hardenable steel having high strength, it is necessary to control the contents of C, Mn, Cr, V, and Mo such that the value represented by Formula (3) showing an index of toughness after aging treatment to be described later is not less than a certain value, and further to control the content of Ti to be not more than a specific value such that inclusions and precipitates which are harmful for toughness are not included in steel.

The present invention has been made based on the above described findings, and its gist is an age-hardenable steel described below.

(1) An age-hardenable steel, having a chemical composition consisting of: by mass %, C: 0.05 to 0.20%, Si: 0.01 to 0.50%, Mn: 1.5 to 2.5%, S: 0.005 to 0.08%, Cr: more than 0.50% and not more than 1.6%, Al: 0.005 to 0.05%, V: 0.25 to 0.50%, Mo: 0 to 1.0%, Cu: 0 to 0.3%, Ni: 0 to 0.3%, Ca: 0 to 0.005%, and Bi: 0 to 0.4%, with the balance being Fe and impurities, wherein P, Ti, and N included in the impurities are: P: 0.03% or less, Ti: less than 0.005%, and N: less than 0.0080%, and further wherein F1 represented by the following Formula (1) is not less than 0.68, F2 represented by the following Formula (2) is not more than 1.05, and F3 represented by the following Formula (3) is not less than 0.12;

$$F1=C+0.3Mn+0.25Cr+0.6Mo \quad (1),$$

$$F2=C+0.1Si+0.2Mn+0.15Cr+0.35V+0.2Mo \quad (2), \text{ and}$$

$$F3=-4.5C+Mn+Cr-3.5V-0.8Mo \quad (3),$$

where each symbol of element in the Formulas (1) to (3) means the content of the element in mass %.

(2) The age-hardenable steel according to the above described (1), wherein the chemical composition contains, by mass %, one or more kinds selected from elements shown in the following <1> to <3>;

<1> Mo: 0.05 to 1.0%,

<2> Cu: 0.1 to 0.3%, and Ni: 0.1 to 0.3%, and

<3> Ca: 0.0005 to 0.005%, and Bi: 0.03 to 0.4%.

(3) The age-hardenable steel according to the above described (1) or (2), wherein the steel contains bainite as a main phase, and an average block size of the bainite is 15 to 60 μm.

(4) The age-hardenable steel according to any of the above described (1) to (3), wherein hardness is not more than 310 HV (5) The age-hardenable steel according to any of the above described (1) to (4), wherein the chemical composition contains, by mass %, Cr: more than 1.0% and not more than 1.6%.

Advantageous Effects of the Invention

The age-hardenable steel of the present invention has hardness before aging treatment of not more than 310 HV. Moreover, according to the age-hardenable steel of the present invention, by aging treatment performed after cutting process, it is possible to ensure a fatigue strength of not less than 480 MPa, and toughness, that is, absorbed energy at 20° C. after aging treatment of not less than 12 J when evaluated by a Charpy impact test performed by using a standard specimen with a U-notch having a notch depth of 2 mm and a notch bottom radius of 1 mm. Therefore, the age-hardenable steel of the present invention can be quite suitably used as a starting material for producing mechanical parts such as for automobiles, industrial machinery, construction machinery, and the like.

MODE FOR CARRYING OUT THE INVENTION

Hereafter, each requirement of the present invention will be described in detail. Note that "%" of the content of each element means "mass %".

C: 0.05 to 0.20%

C is a crucial element in the present invention. C combines with V and forms a carbide, thereby strengthening the steel. However, when C content is less than 0.05%, the carbide of V becomes not likely to precipitate, and therefore desired strengthening effect cannot be achieved. On the other hand, when C content is excessively large, the amount of C which does not combine with V and Mo, but combines with Fe to form carbide (cementite) increases, thereby deteriorating the toughness of steel. Therefore, C content is specified to be 0.05 to 0.20%. The C content is preferably not less than 0.08%, and more preferably not less than 0.10%. Moreover, the C content is preferably not more than 0.18%, and more preferably not more than 0.16%.

Si: 0.01 to 0.50%

Si is useful as a deoxidizing element during steel making, and also has an effect of dissolving into matrix and thereby increasing the strength of steel. To achieve such effects satisfactorily, Si content of not less than 0.01% is required. However, when the Si content is excessive, hot workability of steel is deteriorated and its hardness before aging treatment increases. Therefore, Si content is specified to be 0.01 to 0.50%. The Si content is preferably not less than 0.06%. Moreover, the Si content is preferably not more than 0.45%, and more preferably less than 0.35%.

Mn: 1.5 to 2.5%

Mn has effects of improving hardenability, and causing the micro-structure to contain bainite as a main phase. Further, Mn also has an effect of decreasing the bainite transformation temperature, thereby refining the bainite structure and improving toughness of the matrix. Further, Mn has an effect of forming MnS in steel, thereby improving chip treatability during cutting. To achieve such effects satisfactorily, Mn content needs to be at least 1.5%. However, since Mn is an element which is likely to segregate during solidification of steel, when its content is excessive, it is inevitable that variation of hardness increases within a steel part after hot forging. Therefore, Mn content is specified to be 1.5 to 2.5%. The Mn content is preferably not less than 1.6%, and more preferably not less than 1.7%. Moreover, the Mn content is preferably not more than 2.3%, and more preferably not more than 2.1%.

S: 0.005 to 0.08%

Since S combines with Mn to form MnS in steel, thereby improving chip treatability during cutting, S content needs to be not less than 0.005%. However, when S content increases, coarse MnS increases thereby deteriorating toughness and fatigue strength, and particularly when S content is more than 0.08%, deterioration of toughness and fatigue strength becomes more profound. Therefore, S content is specified to be 0.005 to 0.08%. The S content is preferably not less than 0.01%. Moreover, the S content is preferably not more than 0.05%, and more preferably not more than 0.03%.

Cr: more than 0.50% and not more than 1.6%

Cr, as well as Mn, has effects of improving hardenability, and causing the micro-structure to contain bainite as a main phase. Further, since Cr also has an effect of decreasing the bainite transformation temperature, thereby refining the bainite structure and improving toughness of the base metal, it is necessary that more than 0.50% of Cr be contained. However, when Cr content is more than 1.60%, hardenability increases so that hardness before aging treatment may be more than 310 HV depending on the size and region of a steel part. Therefore, Cr content is specified to be more than 0.50% and not more than 1.6%. The Cr content is preferably not less than 0.6%, and more preferably more than 1.0%. Moreover, the Cr content is preferably not more than 1.3%.

Al: 0.005 to 0.05%

Al is an element having a deoxidizing effect, and to achieve such an effect, Al content needs to be not less than 0.005%. However, when Al content is excessive, coarse oxides are likely to be produced, thereby deteriorating toughness. Therefore, the Al content is specified to be 0.005 to 0.05%. The Al content is preferably not more than 0.04%.

V: 0.25 to 0.50%

V is the most crucial element in the steel of the present invention. V has an effect of combining with C to form fine carbides during aging treatment, thereby increasing fatigue strength. Moreover, when Mo is contained in steel, V has an effect of being compounded with Mo and precipitated by aging treatment, further increasing age hardenability. To achieve such effects satisfactorily, V content needs to be not less than 0.25%. However, when V content is excessive, undissolved carbonitrides are likely to remain even during heating for hot forging, thereby causing deterioration of toughness. Further, when V content is excessive, the hardness before aging treatment may increase. Therefore, V content is specified to be 0.25 to 0.50%. The V content is preferably less than 0.45%, and more preferably not more than 0.40%. Moreover, the V content is preferably not less than 0.27%.

Mo: 0 to 1.0%

Mo, as well as V, has a relatively low precipitation temperature of carbide, and is an element which can be readily utilized for age-hardening. Mo has effects of improving hardenability, causing the micro-structure after hot forging to contain bainite as a main phase, and increasing its area fraction. In steel containing not less than 0.25% of V, Mo is compounded with V to form a carbide, thereby increasing age-hardenability. For that purpose, Mo may be contained as needed. However, since Mo is a very expensive element, an increase in its content will cause an increase in steel manufacturing cost, and also deterioration of toughness. Therefore, when Mo is contained, its content is specified to be not more than 1.0%. The content of Mo is preferably not more than 0.50%, more preferably not more than 0.40%, and further preferably less than 0.30%.

On the other hand, to stably achieve the above described effects of Mo, its content is preferably not less than 0.05%, and more preferably not less than 0.10%.

Each of Cu and Ni has an effect of increasing fatigue strength. Therefore, when higher fatigue strength is desired, these elements may be contained in the following range.

Cu: 0 to 0.3%

Cu has an effect of increasing fatigue strength. Therefore, Cu may be contained as needed. However, when Cu content increases, hot workability deteriorates. Therefore, when Cu is contained, its content is specified to be not more than 0.3%. The Cu content is preferably not more than 0.25%.

On the other hand, to stably achieve the above described effect of Cu of increasing fatigue strength, its content is preferably not less than 0.1%.

Ni: 0 to 0.3%

Ni has an effect of increasing fatigue strength. Moreover, Ni also has an effect of suppressing the deterioration of hot workability due to Cu. Therefore, Ni may be contained as needed. However, increase of Ni content causes saturation of the above described effect in addition to increase of cost. Therefore, when Ni is contained, its content is specified to be not more than 0.3%. The Ni content is preferably not more than 0.25%.

On the other hand, to stably achieve the above described effects of Ni, its content is desirably not less than 0.1%.

As for the above described Cu and Ni, only one of them, or two of them in combination may be contained. The total content of the above described elements, when they are contained, may be 0.6% at which each of Cu and Ni contents has its upper limit value.

Each of Ca and Bi has an effect of prolonging tool life during cutting. Therefore, when further prolonged tool life is desired, these elements may be contained within the following range.

Ca: 0 to 0.005%

Ca has an effect of prolonging tool life. Therefore, Ca may be contained as needed. However, when Ca content increases, coarse oxides are formed, thereby deteriorating toughness. Therefore, when Ca is contained, its content is specified to be not more than 0.005%. The Ca content is preferably not more than 0.0035%.

On the other hand, to stably achieve the above described effect of Ca for prolonging tool life, the Ca content is desirably not less than 0.0005%.

Bi: 0 to 0.4%

Bi has an effect of reducing cutting resistance and thereby prolonging tool life. Therefore, Bi may be contained as needed. However, when Bi content increases, hot workability deteriorates. Therefore, when Bi is contained, its content is specified to be not more than 0.4%. The Bi content is preferably not more than 0.3%.

On the other hand, to stably achieve the above described effect of Bi for prolonging tool life, the Bi content is preferably not less than 0.03%.

As for the above described Ca and Bi, only one of them, or two of them in combination may be contained. The total content of these elements, when they are contained, may be 0.405% at which each of Ca and Bi contents has its upper limit value, but is preferably not more than 0.3%.

The age-hardenable steel of the present invention is a steel having a chemical composition consisting of the above described elements, with the balance being Fe and impurities, wherein P, Ti, and N included in the impurities are: P: 0.03% or less, Ti: less than 0.005%, and N: less than 0.0080%, and further wherein, F1 represented by the above described Formula (1) is not less than 0.68, F2 represented by the above described Formula (2) is not more than 1.05, and F3 represented by the above described Formula (3) is not less than 0.12.

Note that impurities refer to those which are mixed from ores as the raw material, scrap, or manufacturing environments when steel material is industrially manufactured.

P: not more than 0.03%

P is contained as an impurity and is an undesirable element in the present invention. That is, P segregates at grain boundaries, and thereby deteriorates toughness. Therefore, the P content is specified to be not more than 0.03%. The P content is preferably not more than 0.025%.

Ti: less than 0.005%

Ti is contained as an impurity and is a particularly undesirable element in the present invention. That is, Ti combines with N and/or C to form TiN and/or TiC, thereby causing deterioration of toughness, and particularly when its content is not less than 0.005%, toughness is significantly deteriorated. Therefore, Ti content is specified to be less than 0.005%. To ensure excellent toughness, the Ti content is preferably not more than 0.0035%.

N: less than 0.0080%

N is contained as an impurity, and is an undesirable element which immobilizes V as a nitride in the present invention. That is, since V which has precipitated as a nitride will not contribute to age hardening, the N content needs to be kept low to suppress precipitation of nitride. For that purpose, the N content needs to be less than 0.0080%. The N content is preferably not more than 0.0070%, and more preferably less than 0.0060%.

F1: not less than 0.68

The age-hardenable steel of the present invention must satisfy the condition that F1 represented by the following Formula (1) is not less than 0.68:

$$F1=C+0.3Mn+0.25Cr+0.6Mo \quad (1),$$

As already described, each symbol of element in the Formula (1) means the content of that element in mass %.

F1 is an index for hardenability. If F1 satisfies the above described condition, the micro-structure after hot forging will contain bainite as a main phase.

When F1 is less than 0.68, since pro-eutectoid ferrite is mixed in the micro-structure after hot forging, and carbide of V will precipitate at phase boundaries, the hardness before aging treatment may increase and age hardenability may decrease.

F1 is preferably not less than 0.70, and more preferably not less than 0.72. Moreover, F1 is preferably not more than 1.3.

F2: not more than 1.05

The age-hardenable steel of the present invention must satisfy the condition that F2 represented by the following Formula (2) is not more than 1.05:

$$F2=C+0.1Si+0.2Mn+0.15Cr+0.35V+0.2Mo \quad (2)$$

As already described, each symbol of element in the Formula (2) means the content of that element in mass %.

F2 is an index showing hardness before aging treatment. When the age-hardenable steel of the present invention only satisfies the above described condition of F1, there may be a case that the hardness before aging treatment becomes excessively high and the cutting resistance during cutting process increases, thereby shortening tool life.

That is, if F2 is more than 1.05, the hardness before aging treatment will become excessively high. To make the hardness before aging treatment not more than 310 HV, it is necessary that the above described content of each alloying element is within the specified range, and the condition of F2 is satisfied after the condition of F1 is satisfied.

F2 is preferably not more than 1.00. Moreover, F2 is preferably not less than 0.60, and more preferably not less than 0.65.

F3: not less than 0.12

The age-hardenable steel of the present invention must satisfy the condition that F3 represented by the following Formula (3) is not less than 0.12:

$$F3=-4.5C+Mn+Cr-3.5V-0.8Mo \quad (3)$$

As already described, each symbol of element in the Formula (3) means the content of that element in mass %.

F3 is an index showing toughness after aging treatment. That is, only satisfying the conditions of F1 and F2 may result in deterioration of toughness after aging treatment, making it impossible to ensure targeted toughness.

That is, when F3 is less than 0.12, toughness after aging treatment will deteriorate. To ensure targeted toughness, it is necessary that the above described content of each alloying element is within the specified range, and the condition of F3 is satisfied after the conditions of F1 and F2 are satisfied.

F3 is preferably not less than 0.30, and more preferably not less than 0.45.

Note that if F1 is not less than 0.68 and F2 is not more than 1.05, there is no need of setting a limit on the upper limit of F3.

The age-hardenable steel of the present invention preferably has an average block size of bainite of 15 to 60 μm. The term "block" of bainite as used in the present invention refers to a region surrounded by boundaries with an orientation difference of not less than 15° when orientation analysis of the micro-structure is performed by an EBSD (Electron BackScatter Diffraction) method. As the average block size of bainite increases, the hardness before aging decreases, and therefore good machinability is obtained. On the other hand, if the average block size is excessively large, toughness will deteriorate. The average block size is more preferably not less than 20 μm. Moreover, the average block size is more preferably not more than 45 μm, and further preferably not more than 30 μm.

The manufacturing method of the age-hardenable steel of the present invention will not be particularly limited, and it may be melted by a general method to adjust the chemical composition.

Hereafter, an example of the method for manufacturing a mechanical part such as for automobiles, industrial machinery, construction machinery, and the like using an age-hardenable steel of the present invention manufactured as described above as the starting material, will be described.

First, from a steel whose chemical composition has been adjusted to be within the above described range, material to be subjected to hot forging (hereafter, referred to as "material for hot forging") will be made.

The above described material for hot forging may be of any kind such as a billet obtained by blooming an ingot, a billet obtained by blooming a continuous casting material, or a steel bar obtained by hot rolling or hot forging those billets.

Next, the above described material for hot forging is subjected to hot forging and further to cutting process to be finished into a predetermined part shape.

Note that in the above described hot forging, for example, the material for hot forging is heated at 1100 to 1350° C. for 0.1 to 300 minutes and thereafter forged such that the surface temperature after finish forging is not less than 900° C., thereafter being cooled to the room temperature with an average cooling velocity in a temperature range of 800 to 400° C. being 10 to 90° C./min (0.2 to 1.5° C./sec). After being cooled in this way, the material is further subjected to cutting process to be finished into a predetermined part shape.

The faster the average cooling velocity in the temperature range of 800 to 400° C., the smaller the average block size of bainite becomes. The lower limit of this average cooling velocity is preferably 15° C./min, and the upper limit is preferably 70° C./min.

Finally, the material is subjected to aging treatment to obtain a mechanical part such as for automobiles, industrial machinery, construction machinery, and the like, which have desired properties.

Note that the above described aging treatment is performed, for example, in a temperature range of 540 to 700° C., and preferably in a temperature range of 560 to 680° C. The retention time of this aging treatment is appropriately adjusted to be, for example, 30 to 1000 minutes depending on the size (mass) of the mechanical part.

Hereafter, the present invention will be described in further detail utilizing examples.

EXAMPLE

Example 1

Steels 1 to 35 having chemical compositions shown in Tables 1 and 2 were melted with a 50 kg vacuum furnace.

Steels 1 to 23 in Tables 1 and 2 are steels whose chemical compositions are within the range defined in the present invention. On the other hand, Steels 24 to 35 in Table 2 are steels whose chemical compositions are out of the conditions defined in the present invention.

Note that the expression "<0.001" in the column of Ti indicates that the content of Ti as an impurity was less than 0.001%.

TABLE 1

| | Chemical composition (mass %) Balance: Fe and impurities | | | | | | | | | | | | | | | | | |
|---|---|---|---|---|---|---|---|---|---|---|---|---|---|---|---|---|---|---|
| Steel | C | Si | Mn | P | S | Cr | Al | Tl | V | N | Mo | Cu | Ni | Ca | Bi | F1 | F2 | F3 |
| 1 | 0.14 | 0.18 | 1.88 | 0.011 | 0.019 | 0.65 | 0.021 | 0.002 | 0.44 | 0.0078 | — | — | — | — | — | 0.87 | 0.79 | 0.36 |
| 2 | 0.17 | 0.25 | 1.93 | 0.010 | 0.018 | 0.87 | 0.034 | 0.003 | 0.40 | 0.0042 | — | — | — | — | — | 0.97 | 0.85 | 0.64 |
| 3 | 0.18 | 0.32 | 2.15 | 0.012 | 0.023 | 1.30 | 0.025 | <0.001 | 0.44 | 0.0051 | — | — | — | — | — | 1.15 | 0.99 | 1.10 |
| 4 | 0.14 | 0.20 | 1.78 | 0.012 | 0.018 | 1.03 | 0.025 | 0.002 | 0.32 | 0.0079 | — | — | — | — | — | 0.93 | 0.78 | 1.06 |
| 5 | 0.16 | 0.21 | 1.83 | 0.017 | 0.021 | 0.60 | 0.025 | <0.001 | 0.35 | 0.0065 | 0.25 | — | — | — | — | 1.01 | 0.81 | 0.29 |
| 6 | 0.14 | 0.20 | 1.80 | 0.009 | 0.018 | 1.51 | 0.025 | 0.003 | 0.33 | 0.0078 | 0.30 | — | — | — | — | 1.24 | 0.92 | 1.29 |
| 7 | 0.09 | 0.30 | 2.30 | 0.010 | 0.018 | 0.65 | 0.032 | <0.001 | 0.40 | 0.0064 | — | — | — | — | — | 0.94 | 0.82 | 1.15 |
| 8 | 0.09 | 0.25 | 1.62 | 0.011 | 0.015 | 1.23 | 0.028 | <0.001 | 0.28 | 0.0072 | 0.25 | — | — | — | — | 1.03 | 0.77 | 1.27 |
| 9 | 0.10 | 0.34 | 1.58 | 0.014 | 0.014 | 0.78 | 0.027 | <0.001 | 0.40 | 0.0055 | 0.12 | — | — | — | — | 0.84 | 0.73 | 0.41 |
| 10 | 0.17 | 0.21 | 1.78 | 0.014 | 0.013 | 1.15 | 0.023 | <0.001 | 0.38 | 0.0073 | — | — | — | — | — | 0.99 | 0.85 | 0.84 |
| 11 | 0.18 | 0.11 | 1.98 | 0.012 | 0.010 | 0.63 | 0.025 | 0.004 | 0.31 | 0.0078 | 0.38 | — | — | — | — | 1.16 | 0.87 | 0.41 |
| 12 | 0.13 | 0.15 | 1.92 | 0.006 | 0.068 | 0.60 | 0.021 | <0.001 | 0.43 | 0.0077 | 0.16 | — | — | — | — | 0.95 | 0.80 | 0.30 |
| 13 | 0.12 | 0.28 | 2.05 | 0.021 | 0.013 | 1.25 | 0.027 | 0.002 | 0.27 | 0.0079 | — | — | — | — | — | 1.05 | 0.84 | 1.82 |
| 14 | 0.10 | 0.43 | 1.75 | 0.011 | 0.032 | 0.61 | 0.035 | <0.001 | 0.39 | 0.0045 | 0.12 | — | — | — | — | 0.85 | 0.75 | 0.45 |
| 15 | 0.11 | 0.12 | 1.85 | 0.019 | 0.019 | 0.88 | 0.043 | <0.001 | 0.29 | 0.0058 | 0.32 | — | — | — | — | 1.08 | 0.79 | 0.96 |

F1 = C + 0.3Mn + 0.25Cr + 0.6Mo

F2 = C + 0.1Si + 0.2Mn + 0.15Cr + 0.35V + 0.2Mo

F3 = −4.6C + Mn + Cr − 3.5V − 0.8Mo

TABLE 2

| | Chemical composition (mass %) Balance: Fe and impurities | | | | | | | | | |
|---|---|---|---|---|---|---|---|---|---|---|
| Steel | C | Si | Mn | P | S | Cr | Al | Ti | V | N |
| 16 | 0.13 | 0.23 | 1.83 | 0.015 | 0.015 | 0.73 | 0.024 | <0.001 | 0.28 | 0.0063 |
| 17 | 0.14 | 0.26 | 1.68 | 0.016 | 0.013 | 0.62 | 0.032 | <0.001 | 0.29 | 0.0036 |
| 18 | 0.10 | 0.13 | 2.10 | 0.021 | 0.019 | 0.81 | 0.011 | 0.002 | 0.28 | 0.0055 |
| 19 | 0.12 | 0.15 | 1.95 | 0.022 | 0.020 | 0.69 | 0.009 | <0.001 | 0.27 | 0.0075 |
| 20 | 0.10 | 0.25 | 1.85 | 0.021 | 0.014 | 0.85 | 0.011 | 0.002 | 0.30 | 0.0065 |
| 21 | 0.12 | 0.20 | 1.71 | 0.013 | 0.015 | 0.64 | 0.029 | 0.001 | 0.32 | 0.0070 |
| 22 | 0.12 | 0.21 | 1.75 | 0.013 | 0.016 | 0.98 | 0.031 | 0.001 | 0.32 | 0.0041 |
| 23 | 0.12 | 0.19 | 1.81 | 0.012 | 0.015 | 1.35 | 0.030 | 0.001 | 0.33 | 0.0066 |
| 24 | * 0.25 | 0.25 | 1.60 | 0.013 | 0.019 | 0.51 | 0.032 | <0.001 | 0.28 | 0.0066 |
| 25 | 0.14 | 0.25 | 1.78 | 0.018 | 0.020 | 0.74 | 0.011 | * 0.028 | 0.43 | 0.0055 |
| 26 | 0.10 | 0.19 | * 1.35 | 0.021 | 0.016 | 0.62 | 0.009 | 0.003 | 0.30 | 0.0078 |
| 27 | * 0.04 | 0.22 | 1.88 | 0.009 | 0.036 | 0.89 | 0.023 | 0.003 | 0.28 | 0.0073 |
| 28 | 0.11 | 0.23 | 2.25 | 0.011 | 0.009 | 0.92 | 0.015 | 0.002 | * 0.11 | 0.0063 |
| 29 | 0.20 | 0.45 | 1.85 | 0.025 | 0.019 | 0.62 | 0.010 | <0.001 | 0.38 | 0.0024 |
| 30 | 0.18 | 0.34 | 2.25 | 0.010 | 0.017 | 1.51 | 0.018 | 0.002 | 0.38 | 0.0077 |
| 31 | 0.15 | 0.08 | 1.85 | 0.023 | 0.012 | 1.45 | 0.021 | <0.001 | * 0.63 | 0.0069 |
| 32 | 0.11 | 0.30 | 1.95 | 0.015 | 0.015 | 0.63 | 0.018 | 0.002 | 0.25 | 0.0077 |
| 33 | 0.07 | 0.20 | 1.52 | 0.025 | 0.018 | 0.52 | 0.013 | 0.004 | 0.43 | 0.0065 |
| 34 | 0.10 | 0.18 | 1.88 | 0.015 | 0.025 | 0.99 | 0.022 | <0.001 | 0.27 | * 0.0181 |
| 35 | 0.09 | 0.02 | 2.01 | 0.015 | 0.033 | 0.82 | 0.031 | <0.001 | 0.27 | * 0.0119 |

TABLE 2-continued

| Steel | Chemical composition (mass %) Balance: Fe and impurities | | | | | | | |
|---|---|---|---|---|---|---|---|---|
| | Mo | Cu | Ni | Ca | Bi | F1 | F2 | F3 |
| 16 | — | — | 0.11 | — | — | 0.86 | 0.73 | 1.00 |
| 17 | 0.21 | 0.08 | — | — | — | 0.93 | 0.74 | 0.49 |
| 18 | 0.12 | 0.04 | 0.11 | — | — | 1.00 | 0.78 | 1.38 |
| 19 | — | — | — | 0.0010 | — | 0.88 | 0.72 | 1.16 |
| 20 | 0.20 | 0.04 | — | — | 0.015 | 0.99 | 0.77 | 1.04 |
| 21 | 0.25 | — | — | — | — | 0.94 | 0.74 | 0.49 |
| 22 | 0.26 | — | — | — | — | 1.05 | 0.80 | 0.86 |
| 23 | 0.28 | — | — | — | — | 1.17 | 0.88 | 1.24 |
| 24 | — | — | — | — | — | 0.85 | 0.77 | * 0.01 |
| 25 | 0.13 | — | — | — | — | 0.94 | 0.81 | 0.28 |
| 26 | — | — | — | — | — | 0.72 | 0.65 | 0.20 |
| 27 | 0.23 | 0.12 | — | — | — | 0.96 | 0.72 | 1.43 |
| 28 | — | — | 0.09 | — | — | 1.02 | 0.76 | 2.29 |
| 29 | — | — | — | — | — | 0.85 | 0.80 | * 0.04 |
| 30 | 0.35 | 0.13 | — | — | — | 1.44 | * 1.09 | 1.34 |
| 31 | — | — | — | — | — | 1.01 | 0.93 | 0.22 |
| 32 | * 1.23 | — | — | — | — | 1.59 | 0.96 | 0.23 |
| 33 | — | — | — | — | — | * 0.89 | 0.62 | 0.22 |
| 34 | — | — | — | — | — | 0.91 | 0.74 | 1.48 |
| 35 | — | — | — | — | — | 0.90 | 0.71 | 1.48 |

F1 = C + 0.3Mn + 0.25Cr + 0.6Mo
F2 = C + 0.1Si + 0.2Mn + 0.15Cr + 0.35V + 0.2Mo
F3 = −4.5C + Mn + Cr − 3.5V − 0.8Mo
"*" mark indicates deviation from the condition defined in the present invention.

The ingot of each steel was heated at 1250° C. and thereafter hot forged into a steel bar having a diameter of 60 mm. Each of the hot-forged steel bars was temporarily allowed to cool to room temperature in the atmosphere. Thereafter, the steel bar was further heated at 1250° C. for 30 minutes and hot forged into a steel bar having a diameter of 35 mm with the surface temperature of the forged material at the time of finishing being kept at 950 to 1100° C. supposing that it is forged into a part shape. After hot forging, each steel bar was allowed to cool to room temperature in the atmosphere. The cooling velocity during cooling in the atmosphere was measured by embedding a thermocouple at a depth of around R/2 ("R" indicates a radius of steel bar) in a steel bar, and reheating the steel bar, which had been hot-forged at the above described condition, up to around the finishing temperature for hot forging and thereafter allowing it to be cooled in the atmosphere. Thus measured average cooling velocity in a temperature range of 800 to 400° C. after forging was about 40° C./min (0.7° C./sec).

For each Test No., some of the steel bars which had been finished to the above described diameter of 35 mm by hot forging and cooled to room temperature were subjected to the investigation of the hardness before aging treatment and the area fraction of bainite in the micro-structure by cutting off both end portions of the steel bar, each having a length of 100 mm, and thereafter cutting out a specimen from the remaining middle portion in a state without aging treatment (that is, as-cooled state).

On the other hand, for each Test No., the rest of the hot-forged steel bars were subjected to aging treatment at 610 to 630° C. for 60 to 180 minutes, and were subjected to the investigation of hardness after the aging treatment by cutting off both end portions of the steel bar, each having a length of 100 mm, and thereafter cutting out a specimen from the remaining middle portion. Moreover, for each Test No., a specimen was cut out from each steel bar and was subjected to the investigation of absorbed energy in a Charpy impact test and fatigue strength after the aging treatment.

The hardness measurement was conducted in the following way. First, a specimen was prepared by transecting a steel bar, embedding it in a resin such that the cut plane became the surface to be inspected, and thereafter mirror-polishing it. Next, hardness measurement was conducted with the testing force being 9.8 N at 10 points around R/2 portion ("R" represents radius) in the surface to be inspected conforming to the "Vickers hardness test—testing method" in JIS Z 2244 (2009). Vickers hardness was determined by arithmetically averaging the values of the 10 points. It was judged that the hardness before the aging treatment was low when the hardness was not more than 310 HV, and this was set as a target.

The measurement of area fraction of bainite in the micro-structure was conducted in the following way. The specimen which was embedded in resin and mirror-polished for hardness measurement was etched with NITAL. Micro-structure of the specimen after etching was photographed at a magnification of 200 by using an optical microscope. The area fraction of bainite was measured by image analysis from a photographed picture. It was judged that the micro-structure became fully bainitic when the area fraction of bainite was not less than 70%, and this was set as a target.

It was judged that toughness was sufficiently high when the absorbed energy at 20° C. after the aging treatment was not less than 12 J when evaluated by a Charpy impact test performed by using a standard specimen with a U-notch having a notch depth of 2 mm and a notch bottom radius of 1 mm, and this was set as a target.

The fatigue strength was investigated by making an Ono-type rotating bending fatigue test specimen whose parallel portion had a diameter of 8 mm, and which had a length of 106 mm. That is, the above described specimen was sampled such that the center of the fatigue test specimen corresponded to the R/2 portion of the steel bar, and the Ono-type rotating bending fatigue test was conducted at room temperature, in the atmosphere, and under the condition that stress ratio was −1, with the number of test being 8. The fatigue strength was determined as the maximum value of stress amplitudes applied to the specimens which have not ruptured up to a number of repetition of $1.0\times10^7$. It was judged that fatigue strength was sufficiently high when the fatigue strength was not less than 480 MPa, and this was set as a target.

The results of the investigations are shown in Table 3. Note that symbols "○" and "x" in the column of "Bainitization" respectively indicate that the area fraction of bainite was not less than 70%, thus achieving the target, and that the same was less than 70%, thus failing to achieve the target. Moreover, the "absorbed energy in Charpy impact test" is denoted as "Charpy absorbed energy" in Table 3. Further, Table 3 additionally shows the difference of hardness in HV between before and after the aging treatment as a "Quantity of hardening [ΔHV]".

TABLE 3

| | | Before aging treatment | | After aging treatment | | | | |
|---|---|---|---|---|---|---|---|---|
| Test No. | Steel | Hardness [HV] | Bainitization | Hardness [HV] | Fatigue strength (MPa) | Charpy absorbed energy (J) | Quantity of hardening [ΔHV] | Remarks |
| A1 | 1 | 283 | ○ | 330 | 530 | 32 | 47 | Inventive |
| A2 | 2 | 292 | ○ | 337 | 540 | 38 | 45 | Example |
| A3 | 3 | 308 | ○ | 356 | 550 | 22 | 48 | |
| A4 | 4 | 295 | ○ | 326 | 520 | 46 | 31 | |
| A5 | 5 | 282 | ○ | 327 | 520 | 42 | 45 | |
| A6 | 6 | 309 | ○ | 367 | 565 | 42 | 58 | |
| A7 | 7 | 303 | ○ | 350 | 530 | 48 | 47 | |
| A8 | 8 | 271 | ○ | 320 | 530 | 49 | 49 | |
| A9 | 9 | 288 | ○ | 338 | 530 | 34 | 50 | |
| A10 | 10 | 294 | ○ | 340 | 520 | 33 | 46 | |
| A11 | 11 | 287 | ○ | 344 | 530 | 26 | 57 | |
| A12 | 12 | 278 | ○ | 334 | 515 | 34 | 56 | |
| A13 | 13 | 287 | ○ | 315 | 520 | 56 | 28 | |
| A14 | 14 | 269 | ○ | 318 | 520 | 42 | 49 | |
| A15 | 15 | 295 | ○ | 335 | 540 | 36 | 40 | |
| A16 | 16 | 283 | ○ | 318 | 520 | 42 | 35 | |
| A17 | 17 | 283 | ○ | 332 | 530 | 36 | 49 | |
| A18 | 18 | 279 | ○ | 324 | 530 | 52 | 45 | |
| A19 | 19 | 288 | ○ | 321 | 510 | 42 | 33 | |
| A20 | 20 | 267 | ○ | 312 | 510 | 52 | 42 | |
| A21 | 21 | 271 | ○ | 322 | 510 | 35 | 51 | |
| A22 | 22 | 285 | ○ | 332 | 530 | 42 | 47 | |
| A23 | 23 | 301 | ○ | 344 | 540 | 51 | 43 | |
| B1 | * 24 | 308 | ○ | 340 | 530 | # 9.6 | 32 | Comparative |
| B2 | * 25 | 293 | ○ | 351 | 540 | # 6.4 | 58 | Example |
| B3 | * 26 | # 318 | # X | 325 | # 450 | 21 | 7 | |
| B4 | * 27 | 273 | ○ | 290 | # 440 | 68 | 17 | |
| B5 | * 28 | 285 | ○ | 305 | # 430 | 76 | 20 | |
| B6 | * 29 | 300 | ○ | 345 | 520 | # 11.2 | 45 | |
| B7 | * 30 | # 335 | ○ | 365 | 520 | 28 | 30 | |
| B8 | * 31 | # 313 | ○ | 373 | 550 | # 8 | 65 | |
| B9 | * 32 | 307 | ○ | 367 | 550 | # 9.6 | 60 | |
| B10 | * 33 | # 323 | # X | 328 | # 460 | 18 | 5 | |
| B11 | * 34 | 272 | ○ | 292 | # 450 | 65 | 20 | |
| B12 | * 35 | 267 | ○ | 291 | # 445 | 62 | 24 | |

"*" mark indicates deviation from the chemical composition condition defined in the present invention.
"#" mark indicates failure to reach target.

As obvious from Table 3, in the case of "Inventive Examples" of Test Nos. A1 to A23 which each had a chemical composition defined in the present invention, the hardness before the aging treatment was not more than 310 HV, and the fatigue strength increased to not less than 480 MPa and further the absorbed energy in the Charpy impact test increased to not less than 12 J as the result of aging treatment, thus respectively achieving the targets so that strength and toughness after the aging treatment were successfully achieved at the same time. Further, the fact that the hardness before the aging treatment was low revealed that reduction of cutting resistance and prolongation of tool life can be expected.

In contrast to this, in the case of "Comparative Examples" of Test Nos. B1 to B12 which were deviated from the definition of the present invention, the target performances have not been achieved.

In Test No. B1, since Steel 24 was used in which C content was as large as 0.25% and moreover F3 was as low as 0.01, the absorbed energy was as low as 9.6 J in the Charpy impact test after the aging treatment, indicating poor toughness.

In Test No. B2, since Steel 25 was used in which Ti content was as high as 0.028%, the absorbed energy was as low as 6.4 J in the Charpy impact test after the aging treatment, indicating poor toughness.

In Test No. B3, since Steel 26 was used in which Mn content was as low as 1.35%, ferrite in addition to bainite structure was produced, the hardness before the aging treatment was as high as 318 HV, and the fatigue strength was as low as 450 MPa, thus failing to reach its target.

In Test No. B4, since Steel 27 was used in which C content was as low as 0.04%, the hardness after the aging treatment was as low as 290 HV, and also the fatigue strength was 440 MPa, thus failing to reach its target.

In Test No. B5, since Steel 28 was used in which V content was as low as 0.11%, the hardness after the aging treatment was as low as 305 HV, and also the fatigue strength was 430 MPa, thus failing to reach its target.

In Test No. B6, since Steel 29 was used in which F3 was as low as 0.04, the absorbed energy was 11.2 J in the Charpy impact test after the aging treatment, thus indicating poor toughness.

In Test No. B7, since Steel 30 was used in which F2 was as high as 1.09, the hardness before the aging treatment was as high as 335 HV, thus failing to reach its target.

In Test No. B8, since Steel 31 was used in which V content was as high as 0.63%, the hardness before the aging treatment was as high as 313 HV, and the absorbed energy was as low as 8 J in the Charpy impact test after the aging treatment, thus failing to reach its target.

In Test No. B9, since Steel 32 was used in which Mo content was as high as 1.23%, the absorbed energy was as low as 9.6 J in the Charpy impact test after the aging treatment, indicating poor toughness.

In Test No. B10, since Steel 33 was used in which F1 was as low as 0.66, ferrite in addition to bainite structure was produced, the hardness before the aging treatment was as high as 323 HV, and moreover the fatigue strength was as low as 460 MPa, thus failing to reach its target.

In Test No. B11, since Steel 34 was used in which N content was as high as 0.0181% deviating from the definition of the present invention, V nitrides are likely to precipitate during hot forging. For that reason, ΔHV was 20 indicating low age-hardenability and the hardness after the aging treatment was as low as 292 HV. Also the fatigue strength after the aging treatment was as low as 450 MPa, thus failing to reach its target.

In Test No. B12, since Steel 35 was used in which N content was as high as 0.0119%, V nitrides are likely to precipitate during hot forging. For that reason, ΔHV was 24 indicating low age-hardenability and the hardness after the aging treatment was as low as 291 HV. Also the fatigue strength after the aging treatment was as low as 445 MPa, thus failing to reach its target.

Example 2

A part of a steel bar having a diameter of 60 mm of each of Steels 21 to 23 and 30, which were fabricated by being hot forged and thereafter being cooled to room temperature in Example 1, was cut out. The cut out steel bar was further heated at 1250° C. for 30 minutes and was hot forged into a steel bar having a diameter of 35 mm with the surface temperature of the forged material at the time of finishing being kept at 950 to 1100° C. supposing that it is forged into a part shape. After the hot forging, the steel bar was allowed to cool in the atmosphere, or by using a blower and mist to a temperature not more than 400° C. at various cooling velocities.

For each Test No., the hardness before aging treatment was measured by using some of the steel bars which, after being finished into a diameter of 35 mm by hot forging, was cooled to a temperature not more than 400° C. by using a blower and mist and further cooled to room temperature.

On the other hand, for each Test No., the rest of the hot-forged steel bars was subjected to aging treatment at 630° C. for 60 minutes. By using specimens sampled from the steel bars which had been subjected to the aging treatment, the hardness after the aging treatment, the absorbed energy in the Charpy impact test, the fatigue strength, and the block size of bainite structure were investigated.

The investigations of the hardnesses before and after the aging treatment, the absorbed energy in the Charpy impact test, and the fatigue strength were conducted under the same conditions as in Example 1. Moreover, target values of these were the same as in Example 1.

Measurement of the block size of bainite structure was conducted in the following way. The specimens embedded in resin and used for hardness measurement were polished again by using colloidal silica. The polished specimens were subjected to orientation analysis of micro-structure by the EBSD method. A region surrounded by boundaries with an orientation difference of not less than 15° was defined as a "block", and the area of each block was determined by image analysis.

An interface between blocks has a complicated shape with unevenness. For that reason, when an observation surface of micro-structure is created in such a way to cut off the vicinity of an uneven end part of a block, it may be observed as if a block enclosed in another block was present. In such a case, measurement accuracy of the area of block will deteriorate. To eliminate such effects, when a certain block was fully enclosed in another block in a cross-sectional image, they were regarded as one block, and the area was determined from a larger block alone, neglecting the enclosed smaller block.

For each block which was subjected to measurement of area as described above, the size of block was defined as the diameter of a circle which has the same area. From the size of each block in region of 30000 $\mu m^2$ analyzed by the EBSD method, an average block size was calculated.

When calculating an average block size, the size of each block was weighted according to the area of the block. That is, for n blocks 1 to n in an analysis region, supposing that the sizes of each block are D1, D2, . . . , Dn (μm), and the areas thereof are S1, S2, . . . , Sn ($\mu m^2$), the average block size was determined as (D1×S1+D2×S2+ . . . +Dn×Sn)/30000. The target of average block size was set to be 15 to 60 μm.

Table 4 shows results of each investigations described above. Test Nos. C1 to C3 correspond to Test Nos. A21 to A23 of Table 3, respectively. The cooling velocity shown in Table 4 is an average cooling velocity in a temperature range of 800 to 400° C. during cooling after hot forging the steel bar having a diameter of 35 mm. The measurement method of the average cooling velocity was the same as that in Example 1.

TABLE 4

| Test No. | Steel | Cooling velocity (° C./s) | Before aging treatment Hardness [HV] | After aging treatment Hardness [HV] | Fatigue strength (MPa) | Charpy absorbed energy (J) | Bainite average block size (μm) | Quantity of hardening [ΔHV] | Remarks |
|---|---|---|---|---|---|---|---|---|---|
| C1 | 21 | 0.7 | 271 | 322 | 510 | 35 | 30.7 | 51 | Inventive Example |
| C2 | 22 | 0.7 | 285 | 332 | 530 | 42 | 24.6 | 47 | |
| C3 | 23 | 0.7 | 301 | 344 | 540 | 51 | 20.7 | 43 | |
| C4 | 22 | 0.8 | 291 | 334 | 530 | 42 | 21.2 | 43 | |
| C5 | 22 | 1.2 | 297 | 338 | 540 | 42 | 18.6 | 41 | |
| C6 | 22 | 1.5 | 306 | 343 | 540 | 40 | 18.1 | 37 | |
| D1 | * 30 | 1.2 | # 346 | 350 | 540 | 30 | # 9.6 | 4 | Comparative Example |

"*" mark indicates deviation from the chemical composition condition defined in the present invention.
"#" mark indicates failure to reach target.

As obvious from Table 4, in the case of "Inventive Examples" of Test Nos. C1 to C6 which each had a chemical composition defined in the present invention, the average block size of bainite was within a target range of 15 to 60 μm, and the hardness before the aging treatment was not more than 310 HV. For that reason, excellent machinability can be expected. The fatigue strength increased to not less than 480 MPa and further the absorbed energy in the Charpy impact test increased to not less than 12 J as the result of the aging treatment, thus respectively achieving the targets so that the strength and toughness after the aging treatment were successfully achieved at the same time. Note that in Test Nos. C1 to C6, the area fraction of bainite before the aging treatment was not less than 70%, thus achieving its target.

Moreover, in Test Nos. C1 to C6, the average cooling velocity satisfied the average cooling velocity (10 to 90° C./min, that is, 0.2 to 1.5° C./sec) shown as one example of the method for manufacturing an age-hardenable steel of the present invention described above. Among Test Nos. C1 to C6, comparing Test Nos. C2 and C4 to C6, which utilized Steel 22, to each other, it is seen that the slower the average cooling velocity, the larger the average block size of bainite becomes. Moreover, it is seen that the larger the average block size of bainite, the lower the hardness before the aging treatment becomes, and thus better machinability can be expected.

In contrast to this, in the case of "Comparative Example" of Test No. D1 which was deviated from the definition of the present invention, the target performance has not been achieved. That is, in Test No. D1, Steel 30 was used in which F2 was large deviating from the definition of the present invention. For that reason, the average block size of bainite was as small as 9.6 μm and the hardness before the aging treatment was 346 HV, which was hard. Therefore, the machinability was considered to be poor.

INDUSTRIAL APPLICABILITY

The age-hardenable steel of the present invention has hardness before aging treatment of not more than 310 HV, and therefore can be expected to have reduced cutting resistance and a prolonged tool life. Moreover, according to the age-hardenable steel of the present invention, by aging treatment performed after cutting process, it is possible to ensure a fatigue strength of not less than 480 MPa, and toughness, that is, absorbed energy at 20° C. after aging treatment of not less than 12 J when evaluated by a Charpy impact test performed by using a standard specimen with a U-notch having a notch depth of 2 mm and a notch bottom radius of 1 mm. Therefore, the age-hardenable steel of the present invention can be quite suitably used as a starting material for producing mechanical parts such as for automobiles, industrial machinery, construction machinery, and so on.

The invention claimed is:

1. An age-hardenable steel, comprising a chemical composition consisting of: by mass %, C: 0.05 to 0.20%, Si: 0.01 to 0.50%, Mn: 1.6 to 2.5%, S: 0.005 to 0.08%, Cr: more than 0.50% and not more than 1.6%, Al: 0.005 to 0.05%, V: 0.25 to 0.50%, Mo: 0 to 1.0%, Cu: 0 to 0.3%, Ni: 0 to 0.3%, Ca: 0 to 0.005%, and Bi: 0 to 0.4%, with the balance being Fe and impurities, wherein P, Ti, and N included in the impurities are: P: 0.03% or less, Ti: less than 0.005%, and N: less than 0.0080%, and further wherein F1 represented by the following Formula (1) is not less than 0.68, F2 represented by the following Formula (2) is not more than 1.05, and F3 represented by the following Formula (3) is not less than 0.12;

$$F1=C+0.3Mn+0.25Cr+0.6Mo \quad (1),$$

$$F2=C+0.1Si+0.2Mn+0.15Cr+0.35V+0.2Mo \quad (2), \text{ and}$$

$$F3=-4.5C+Mn+Cr-3.5V-0.8Mo \quad (3),$$

where each symbol of element in the Formulas (1) to (3) means the content of the element in mass %, wherein the steel contains bainite as a main phase, and an average block size of the bainite is 20.7 to 60 μm.

2. The age-hardenable steel according to claim 1, wherein at least one of <1> Mo, <2> Ni and Cu, and <3> Ca and Bi, is contained in an amount, by mass %, as follows:

<1> Mo: 0.05 to 1.0%,

<2> Cu: 0.1 to 0.3%, and Ni: 0.1 to 0.3%, and

<3> Ca: 0.0005 to 0.005%, and Bi: 0.03 to 0.4%.

3. The age-hardenable steel according to claim 1, wherein hardness is not more than 310 HV.

4. The age-hardenable steel according to claim 2, wherein hardness is not more than 310 HV.

5. The age-hardenable steel according to claim 1, wherein the Cr content is, by mass %, more than 1.0% and not more than 1.6%.

6. The age-hardenable steel according to claim 2, wherein the Cr content is, by mass %, more than 1.0% and not more than 1.6%.

7. The age-hardenable steel according to claim 3, wherein the Cr content is, by mass %, more than 1.0% and not more than 1.6%.

8. The age-hardenable steel according to claim 4, wherein the Cr content is, by mass %, more than 1.0% and not more than 1.6%.

* * * * *